United States Patent [19]

Deutsch

[11] 4,160,399

[45] Jul. 10, 1979

[54] AUTOMATIC SEQUENCE GENERATOR FOR A POLYPHONIC TONE SYNTHESIZER

[75] Inventor: Ralph Deutsch, Sherman Oaks, Calif.

[73] Assignee: Kawai Musical Instrument Mfg. Co. Ltd., Hamamatsu, Japan

[21] Appl. No.: 773,804

[22] Filed: Mar. 3, 1977

[51] Int. Cl.[2] ..... G10F 1/00

[52] U.S. Cl. ..... 84/1.03; 84/461; 84/470 R; 84/1.17; 84/5

[58] Field of Search ..... 84/461, 470, 1.17, 1.13, 84/1.01, 1.03, 5; 179/15; 178/50

[56] References Cited

U.S. PATENT DOCUMENTS

| | | | |
|---|---|---|---|
| 3,604,299 | 9/1971 | Englund | 84/1.03 |
| 3,890,871 | 6/1975 | Oberheim | 84/1.03 X |
| 3,915,047 | 10/1975 | Davis et al. | 84/1.03 |
| 3,986,423 | 10/1976 | Rossum | 84/1.03 X |

*Primary Examiner*—Ulysses Weldon

*Attorney, Agent, or Firm*—Christie, Parker & Hale

[57] ABSTRACT

A sequence generator for a polyphonic tone synthesizer in which a repetitive sequence of musical notes or chords are generated automatically. During a Code mode of operation, each key operated on the keyboard causes an associated data word identifying the specific key by keyboard, octave and note to be stored in a memory. Time data as to the relative time the note is to go on and go off is also stored as part of the data word. During a Play mode of operation, the data words are read out of memory in the sequence in which they were generated. The words are decoded and the time data compared with a real time clock to provide signals to the output of the keyboard which duplicate the signals from the corresponding keys. The time duration of these signals is controlled by the time on and time off data to duplicate the required time that the respective notes are to be played.

14 Claims, 5 Drawing Figures

| DIV (2 BITS) | GROUP (3 BITS) | NOTE (4 BITS) | ON (8 BITS) | OFF (8 BITS) |
|---|---|---|---|---|

AUTOMATIC SEQUENCE GENERATOR FOR A POLYPHONIC TONE SYNTHESIZER

FIELD OF THE INVENTION

This invention relates to digital organs, and more particularly, is concerned with a sequence generator for automatically generating a repetitive sequence of musical notes or chords.

BACKGROUND

Electronic organs have heretofore employed a device called a sequencer which is used to create and control a number of repeated musical events. One function of the sequencer is to produce an effect known in classical music as "ostinati" or ground basses. For example, sequencers have been used to create rather elaborate accompaniments. While the sequencer produces the accompaniment, a musician can play the lead line on the same or another keyboard, or even another instrument. While analog sequencers have been used, digital sequencers are currently more widely accepted because they offer greater flexibility.

Known digital sequencers utilize a Read/Write memory storing a plurality of words, each word being coded to represent a note played on a keyboard. Typically, each word corresponds to one beat or a half beat. If the time resolution is an eighth note, for example, the Read/Write memory will store eight words per measure, the capacity of the memory fixing the number of measures of the music that can be played. If a note is being held as a quarter note, then two successive words must be coded for the same note. Rests are coded by having an appropriate number of blank words. Once the memory has been coded, the sequencer can be used to play the keyboard instrument by reading back the data words in the memory in time sequence. The tempo can be varied by varying the rate at which the words are read out of the memory.

Known sequencers, however, are monophonic, that is they are capable of generating or playing only one note at a time. They also do not make efficient use of memory space since they require separate coded words for each beat or half-beat of a measure including rests.

SUMMARY OF THE INVENTION

These and other disadvantages of the prior art digital sequencers are overcome by the present invention which provides a digital sequencer that is polyphonic, enabling it to play back chords as well as individual notes. The sequencer can play notes on any of the keyboards, and only the actual notes played are coded in memory for playback regardless of time value of the note. Rests need not be coded in memory.

In brief, the present invention provides an automatic sequencer for a keyboard instrument in which each key operates a switch, which in turn operates to initiate and terminate a corresponding musical note when the key is depressed and released. The sequencer comprises a sequencer memory for storing data identifying the notes to be played by the sequencer. Means responsive to the key operated switches actuated during a code mode of operation loads the sequencer memory with data words, each data word identifying one of the keys operated during the code mode. Time generating means counts the musical beats of the notes played by operation of the keys during the coding mode. Means responsive to the time generating means stores data with each word in the sequencer memory indicating the relative beat time that the associated key was depressed. Additional means responsive to the time generating means stores data with each word in the sequencer memory indicating the relative beat time that the associated key was released.

During a playback mode of the sequencer, a plurality of keyer circuits, corresponding in number to the maximum number tones to be generated simultaneously by the polyphonic tone generator receive data words from the sequencer memory on demand. Each keyer circuit includes means responsive to the note identifying data and the relative time-on data of the word received from the memory for initiating the corresponding note from the polyphonic tone generator. The keyer includes additional means responsive to the relative time-off data of the word received from the memory for terminating the corresponding note.

DESCRIPTION OF THE DRAWINGS

For a more complete understanding of the invention, reference should be made to the accompanying drawings wherein:

FIGS. 1*a* and 1*b* are a schematic block diagram of the invention incorporated as part of an overall keyboard switch detect and assignor circuit;

DETAILED DESCRIPTION

Figure 1A:
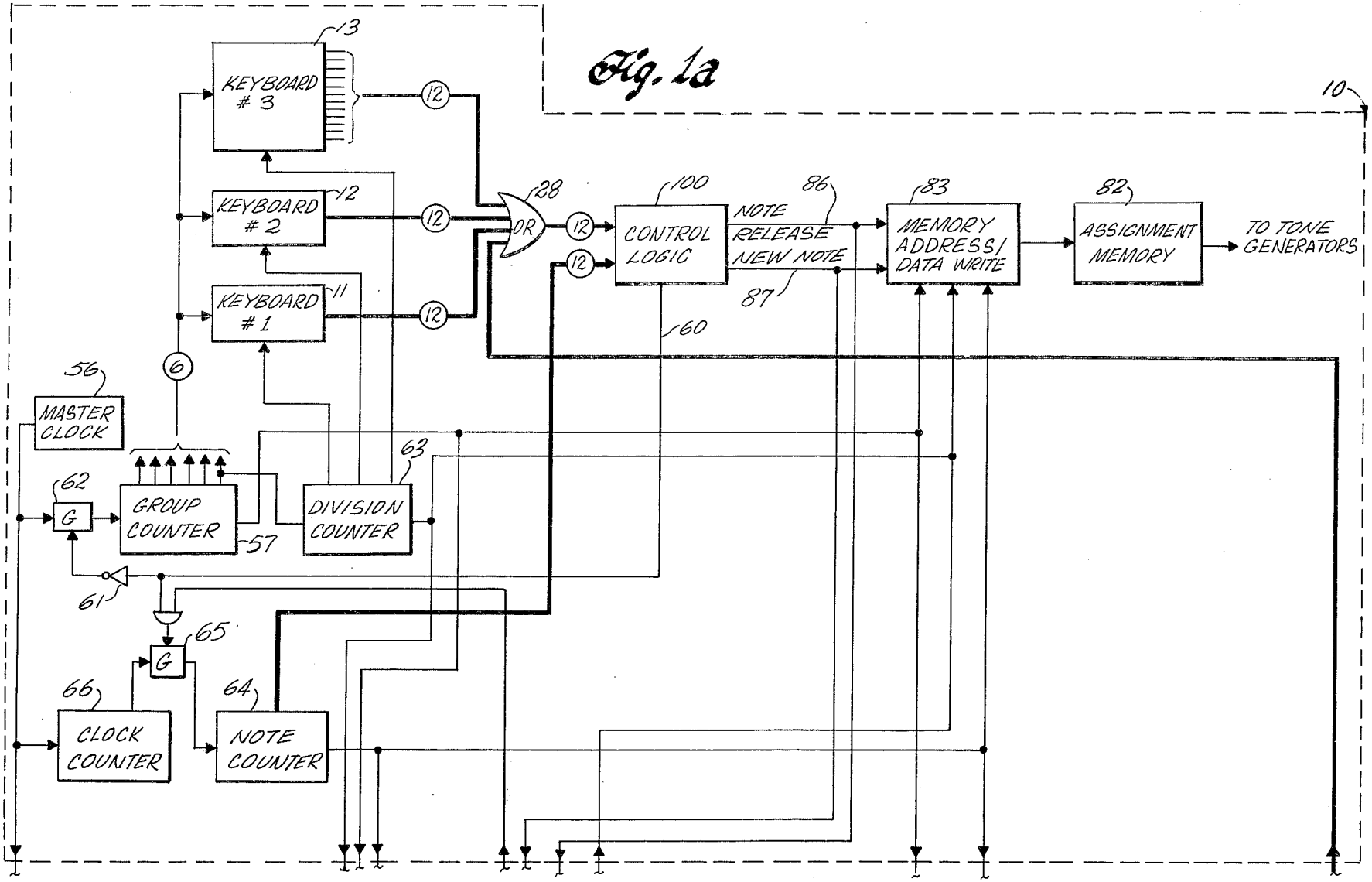
Figure 16:
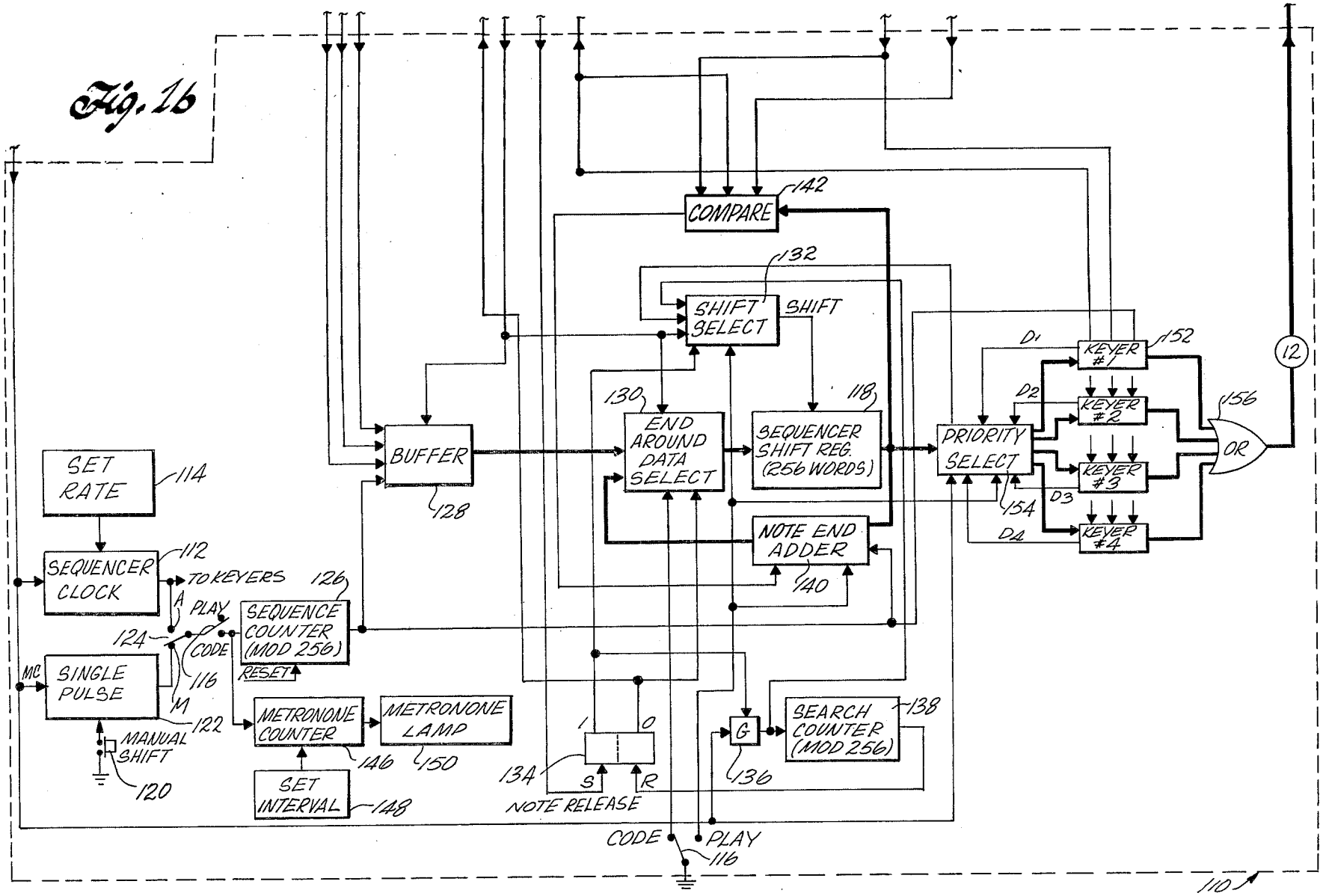

The preferred embodiment of the sequencer according to the present invention is shown and described in combination with a keyboard switch detect and assignor circuit, indicated generally at 10 in FIG. 1*a* described in detail in U.S. Pat. No. 4,022,098 and incorporated herein by reference, filed Oct. 6, 1975. In the drawings, those elements of the switch detect and assignor circuit 10 which are common to the circuit described in the above-identified co-pending application are identified by the corresponding reference characters and are limited to two-digit numbers. Newly added circuit elements forming the sequencer as herein described are identified in the drawings by three-digit reference numbers.

The basic keyboard switch detect and assignor circuit 10 provides a system for detecting a change of state of any one of the key operated switches in a keyboard musical instrument and causes one of a plurality of tone generators to be assigned in response to the pressing down of the key. The assigned tone generator is released when the key is subsequently released.

Referring to FIG. 1*a*, three separate keyboards, indicated at 11 and 12 and 13 are shown by way of example. Each keyboard, one of which may be a foot operated pedal keyboard, typically contains six octaves, there being twelve notes per octave corresponding to the notes of a conventional chromatic scale. Each keyboard, called a division, has the notes of the octaves arranged in groups, each group corresponding to one octave. During a Scan mode, multiplexing or scanning of the keys by divisions and groups is provided respectively by a division counter 63 and a group counter 57 which connect the twelve keys of each of the eighteen groups in sequence to twelve output lines (as indicated by the number 12 in a circle) through an OR circuit 28.

Control logic 100, the details of which are described in the above-identified application provides an output signal on a line 60 indicating whether the circuit is in a Scan mode or in an Assign mode. The control logic is normally in the Scan mode until one of the key operated switches changes state. In the Scan mode when the control signal on line 60 goes off, the output of an inverter 61 goes on permitting clock pulses from a master clock source 66 to pass through a gate 62 to the group counter 57. The group counter is advanced repeatedly through its six states. At the end of each group scan the group counter advances the division counter 63 by which the successive keyboards are scanned.

Whenever a key is depressed, the control logic 100 senses the change in status of the key and turns on the signal on the output line 60 to indicate the Assign mode of operation. During the Assign mode, counting of the group counter 57 and division counter 63 is interrupted. These two counters identify the group and division of a key whose status has changed. When in the Assign mode, a note counter 64 begins to count in response to pulses from a clock counter 66 through gate 65. The note counter 64 scans each of twelve registers (not shown) in the control logic 100 to determine which of the twelve notes in a group has changed its status. If a new key in the group has been depressed, the control logic 100 generates an output signal on the line 87, indicating that there is a new note. If, on the other hand a key has been released, the control logic provides an output signal on the line 86 indicating that the note has been released. The new note signal on line 87 is applied to a Memory Address/Data Write Control circuit 83 which operates to store a word in an unassigned memory location in an Assignment memory 82. The Assignment memory stores a control word for each tone generated in the system. Each word written in the Assignment memory includes coded information from the note counter 64 as to the particular note in a group which has been depressed, and includes coded information from the group and division counters as to which groups and division the depressed key is located. When a key is released, the note release signal on line 86 causes the associated control word in the assignment memory to be erased so that a new control word can be assigned to the associated tone generator, in response to the other keys when depressed.

The description thus far relates to a keyboard control circuit for detecting the operation of key-operated switches and assigning a tone generator to each key as it is operated. The present invention is directed to a sequencer, indicated generally at 110 in FIG. 1*b*, for simulating the operation of the keys so as to operate the tone generator automatically. The sequencer circuit includes its own sequencer clock 112 which is synchronized with the system master clock 56. The rate of the sequencer clock is adjustable by a set rate control 114. The frequency of the output of the sequence counter determines the rhythm or tempo of the notes played by the sequencer 110 . The sequencer 110 operates in two basic modes, a CODE mode and a PLAY mode. During the CODE mode, the sequencer is loaded with the coded information as to the notes to be played and the timed sequence in which the notes are to be played automatically by the sequencer. During the PLAY mode, this information is used to control the key switch detect and assignor circuit 108 to control the Assignment memory 82 just as though the actual keys were being operated on their respective keyboards. The mode of operation may be selected manually by means of a switch 116 which can be set either to the CODE position or the PLAY position.

Figures 1C, 2:
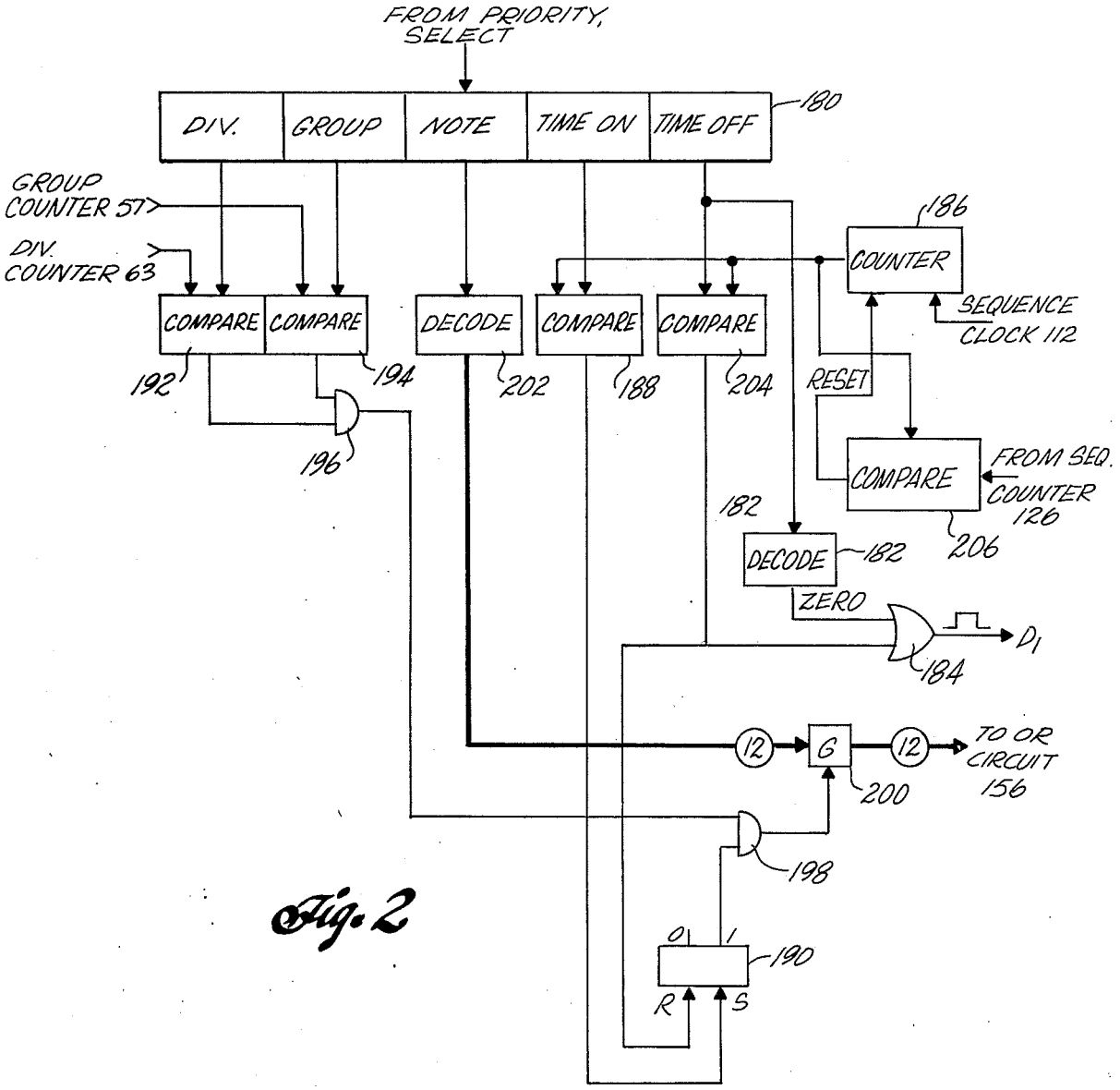
FIG. 1*c* is a diagram of the format of a stored word.
FIG. 2 is a detailed block diagram of the keyer circuit portion of the present invention.

Considering first the CODE mode of operation, a sequencer memory 118, preferably in the form of a shift register, is loaded with information identifying each of the notes to be played, and the timing information as to the relative time each note is to go on and turn off. The shift register, for example, may store up to 256 binary coded words, each word containing data on one note to be played by the sequencer. FIG. 1*c* shows the format of each word stored in the sequencer memory 118. Thus, the first two bits identify the keyboard division of the note to be played, the next three bits identify the octave group of the note to be played, the next four bits identify the note within the octave to be played, the next eight bits identify the relative time at which the note is to be turned on, and the last eight bits identify the relative time in which the note is to be turned off.

The data words can be generated and loaded in the sequencer shift register 118 automatically at a rate fixed by the sequencer clock 112 or manually at a rate determined by operation of a manual shift pushbutton switch 120, which, when operated, activates a single-pulse generator 122 synchronized with a master clock pulse from the master clock source 56. A switch 124 can be set to select pulses from the output of the sequencer clock 112 or the single pulse generator 122 and apply the pulses to a sequence counter 126 which is preferably a modulo 256 binary counter. The sequence counter provides the relative time data for each note stored in the memory 118 during the CODE mode. The sequencer counter in effect counts each minimum note interval within the resolution of the system. For example, if the minimum note interval is selected to correspond to an eighth note, the sequence counter counts the number of eighth note intervals in the series of notes to be played by the sequencer. The group counter 57, division counter 63, and note counter 64 provide the division group and note information for the words stored in the memory 118.

With the sequence counter reset to 0 at the start of the CODE mode, the operator may operate up to four keys on any of the keyboards 11, 12 and 13, four notes being the selected capacity of the polyphonic sequencer illustrated in the figures. However, it will be understood that the sequencer can be designed to accommodate any number of simultaneously played notes up to the capability of the polyphonic tone generator with which it is used. When more than one key is depressed simultaneously, the control logic 100 in the key detect and assigner circuit 10 examines each of these notes in sequence, generating a new note signal on the output line 87 at the start of the ASSIGN mode for each note detected during the SCAN mode. The new note signal on the line 87 is applied to a buffer 128 for loading the buffer with the count condition of the group counter 57, the division counter 63, note counter 64, and sequence counter 126. This data in the buffer 128 is applied to the sequencer shift register 118 through an end around data select circuit 130 which operates to selectively connect one of two data inputs to the sequencer shift register 118. Initially in the CODE mode, the end around data select circuit 130 is set to connect the buffer 128 to the input of the sequencer shift register 118.

With one or more keys operated on the keyboards, with each new note signal on the line 87, a corresponding word is stored in the sequencer shift register 118 identifying the division, group, note and time on for each key. It should be noted that the sequencer counter 126 provides the same time on information for each of the keys played simultaneously, even though the data on each of the corresponding notes is loaded sequentially as successive words in the shift register 118. A shift select circuit 132 selectively couples shift pulses to the sequencer shift register 118 from one of the three sources. Initially, the shift select circuit 132 selects shift pulses from the new note output line 87 of the control logic circuit 100 so that the sequencer shift register 118 is shifted one word with each new note signal.

As indicated before, when operating manually during the CODE mode, the switch 124 advances the sequence counter 126 in response to a manual shift button 120. When one or more selected keys are depressed, the operator pushes the manual shift button 120 one or more times, depending upon how many eighth note intervals the note or notes associated with the depressed keys are to be sustained. For example, if a key depressed on the keyboards is to sound a quarter note, the operator would activate the manual shift button 120 twice and then release the key. By advancing the sequence counter 126 twice, the sequence counter now indicates the eighth note interval at which the key is being released. This time off information must be loaded in the time off portion of the word (or words if more than one key is being released at one time) already loaded in the sequencer shift register 118 in the manner described above.

The loading of the time off information is accomplished in the following manner. As each key on the keyboard is released, the control logic 100 generates an output pulse on the note release line 86 in the manner described in the above-identified application. The note release signal sets a latch or a flip-flop 134. With the latch 134 set, it signals the shift select circuit 132 to select shift pulses from the master clock source 56 through a gate 136. This causes the sequencer shift register to be shifted at the master clock rate. The shift pulses are also applied from the gate 136 to a search counter 138, which is a modulo 256 binary counter initially set to zero. After 256 clock pulses are counted, an overflow pulse from the counter 138 resets the latch 134, interrupting the shifting of the sequencer shift register 118. As the sequencer shift register 118 is shifted by the clock pulses, the data words shifted out of the register are recirculated back to the input of the shift register 118 through a Note Off adder 140 and through the end around data select circuit 130. As each word is shifted out of the sequencer shift register 118, it is applied to a compare circuit 142 which compares the division, group and note bits of each word with the division, group and note status of the counters 63, 57 and 64. It should be noted that the count condition of the group counter 57 and division counter 63 remain fixed during this time because the ASSIGN mode level on line 60 from the control logic 100 has turned off the gate 62. The note counter 64 is held fixed at this time by turning off the gate 65 when the control flip-flop 134 is in its SET state.

When the read out of the sequencer shift register 118 compares with the note that has been released, the compare circuit 142 provides an output signal which is applied to the Note Off adder 140 causing the status of the sequence counter 126 to be added in the time off portion of the word being recirculated from the output of the sequencer shift register 118 back to the input. Thus, the note release signal modifies the corresponding word in the sequencer shift register 118 to indicate the relative time at which the note was released, as indicated by the status of sequence counter 126.

After all the words in the sequencer shift register 118 have been recirculated, the search counter 138 resets the flip-flop 134. It will be noted that the sequencer shift register 118 is recirculated back to its initial condition at the time the note release signal was received so that it is ready to receive additional note identifying words in sequence in response to a new note signal on the line 87 from the control logic 100.

From the description thus far, it will be seen that sequencer shift register 118 is loaded with a plurality of consecutive words indicating each note that has been initiated on the keyboard and indicating the relative time from the start of the CODE mode sequence, measured in terms of a predetermined number of note intervals per measure, at which the note goes on and subsequently goes off. Once all the notes of a particular sequence have been stored in this manner in the sequencer shift register 118, the CODE mode is completed. The coding can be carried out manually by the operator at his own pace, without regard to real time, by using the manual shift switch 120. Since the relative time at which each note is to be turned on and to be turned off is coded, the notes can be played back in the proper sequence at any selected tempo.

For a more skilled operator or for a less complex pattern of notes, the CODE mode can be carried out using the sequencer clock 112 rather than the manual switch 120. The sequencer clock can be set at any convenient tempo at which the operator can play the notes on the keyboard just as though he were playing the instrument. To synchronize the tempo at which he plays with the rate set by the sequencer clock 112, a metranome counter 146 is connected to the output of the sequencer clock 112 through the switch 124. The metranome counter can be set to provide an overflow pulse after a predetermined number of input pulses, as determined by a Set Interval control 148. For example, if the sequencer resolution is based on eighth note intervals and the operator is applying in the three/four meter, i.e., three quarter notes to the measure, the metranome counter 146 can be set to provide an output pulse to a metranome lamp 150 following six input pulses from the sequencer clock 112. Thus, the metranome lamp flashes at the start of each measure, for example, to assist the operator to synchronize his playing tempo with that of the sequencer clock 112. Alternatively, the metranome lamp 150 could be set to flash with each two sequencer clock pulses so as to provide a flash for each quarter note beat.

Once the note information is loaded in the sequencer register 118, the switch 116 can be switched to the PLAY mode and the instrument caused to generate the corresponding tones automatically just as though the keys on several keyboards were being manually actuated. This is accomplished by a group of four keyer circuits 152. The number of keyer circuits is determined by the polyphonic capacity of the sequencer, four being given by way of example only, as noted above. At the start of the PLAY mode, the sequencer shift register 118 is storing a plurality of words coded to identify each of the keys operated during the CODE mode of operation. This may be any number of words up to the 256 word capacity of the shift register. Normally the number of words would be considerably less than the capacity of the sequencer shift register. Because the shift register 118 is initialized to zero for all bits stored in the sequencer shift register, the unused or unassigned words of the sequencer shift register 118 can be identified by the presence of all zero bits in the time off portion of each word. The assigned words are shifted out of the sequence shift register in the same order in which they were loaded in the shift register, which is the order in which the corresponding keys were operated on the keyboards. Words corresponding to keys which are operated simultaneously appear in a predetermined sequence in the sequencer shift register 118 determined by the scanning sequence of the division, group and note counter.

Figure 3:
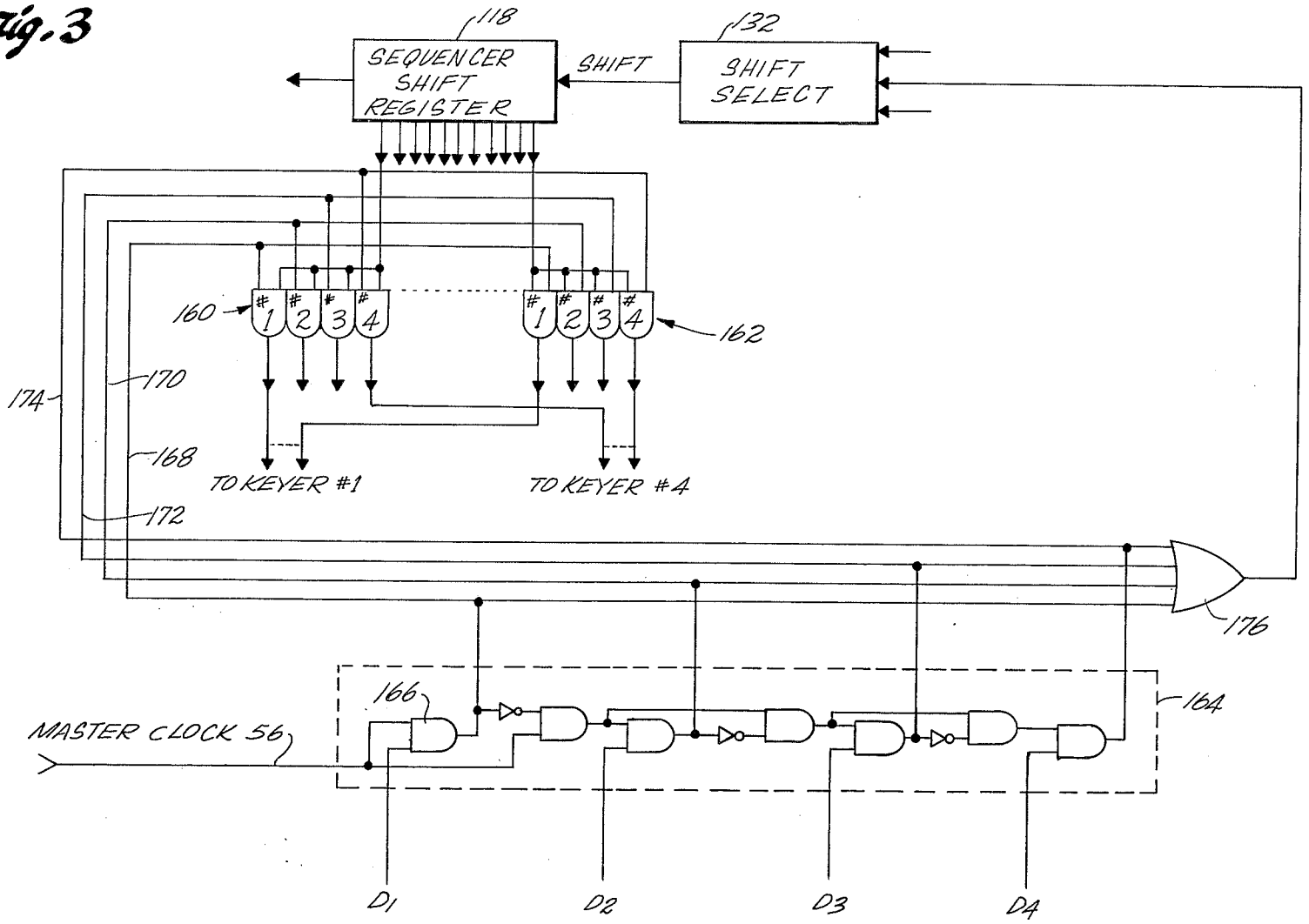
FIG. 3 is a schematic block diagram of the priority select circuit incorporated in the present invention.

The words are shifted out of the sequencer shift register 118 into a priority select circuit 154, shown in detail in FIG. 3. The priority select circuit provides shift pulse to the shift register 118 through the shift select circuit 132 whenever the switch 116 is set to the PLAY mode. The priority select circuit 154 causes the words as they are shifted out of the register 118 to be loaded into buffers in the respective keyers 152. Each keyer circuit compares a timing counter, which is driven from the sequencer clock 112, with the time on information of the note word in the buffer. When the sequence counter is the same as the time on, the keyer applies the note information through an OR circuit 156 directly to the OR circuit 28 in parallel with signals from the keys to the input to the control logic 100. The keyer circuit also compares the division and group information in the word in its buffer with the count condition of the group counter 57 and division counter 63 so as to apply the note information to the control logic 100 at the proper point in time in which the corresponding key is being scanned. Thus, the note signal received by the control logic 100 from the keyer is identical to the signal it would receive if the corresponding key had been operated at the same point in time on the corresponding keyboard. The control logic 100 then functions to assign the note to a tone generator in the same manner as described in the co-pending application. The keyer subsequently compares the note off data in the buffer with the timing counter to turn off the note signal at the output of the OR circuit 156 at the appropriate time, just as though the corresponding key had been released on the keyboard.

Referring to FIG. 3, the priority select circuit 154 is shown in detail. The output lines from the sequencer shift register 118 are each connected to an associated group of four gates, two such groups being indicated at 160 and 162. The output of each gate in a group goes to a different one of the four keyer circuits 152. The four gates in each group are strobed by master clock pulses from the clock source 56 by means of a priority gating logic circuit 164. The priority gating logic is controlled by demand signals from each of the keyers designated $D_1$, $D_2$, $D_3$, and $D_4$ respectively. When the demand signal $D_1$ is ON, a clock pulse is applied to the first gate of each of the groups 160–162 by an AND gate 166 over a control line 168. If $D_1$ is OFF but $D_2$ is ON, the priority logic circuit 164 gates the master clock to a control line 170 going to the second gate in each of the groups 160–162. Similarly, if both $D_1$ and $D_2$ are OFF but $D_3$ is ON, the clock pulse is passed to the third gate of each of the groups 160–162 by priority logic circuit 164. Finally, if only $D_4$ is ON, a clock pulse is directed to the fourth gate of each of the groups 160–162.

To shift the sequencer shift register 118, all of the control lines from the priority logic circuit 164 are applied through an OR circuit 176 to the shift select circuit 132, which is set during the PLAY mode to connect the clock pulses appearing at the output of the OR circuit 176 to the shift input of the register 118. Thus, whenever there is a demand signal from at least one of the keyers, the output liner corresponding to each of the bits of a word in the sequence shift register are gated to the highest priority one of the keyers making a demand.

Referring to FIG. 2, the keyer circuit is shown in detail. Each keyer includes a one word buffer register 180 which is loaded on demand with a word from the sequencer shift register 118 in the manner described above in connection with FIG. 3. The Time Off bits of the word in the buffer 180 are decoded by decode circuit 182. A zero in the Time Off portion of the word in the buffer 180 indicates an unassigned word. When the Time Off bits are all zero, the output of the decode circuit 182 is set ON. The output is applied through an OR circuit 184 to the output line $D_1$, providing a demand signal to the priority select circuit 154 in the manner described above. This causes the priority select circuit 154 to load another word in the buffer register 180 from the sequencer shift register 118 with the next clock pulse. This process continues until an assigned word, having non-zero Time Off data, is loaded in the buffer 180.

The Time On data of each word loaded in the buffer 180 is compared with the count condition of a timing counter 186 that is set to zero at the start of the PLAY mode of the sequencer. The counter 186 is advanced by pulses from the sequencer counter 112 which is set to control the tempo of the notes played by the sequencer. If the Time On bits correspond to the bit condition of the counter 186, a compare circuit 188 provides an output signal which is applied to the SET input of a latch or flip-flop 190. A comparison is then made using the group counter 57 and division counter 63 as they scan the groups of key-operated switches in the keyboards with the division and group bits stored in the buffer register 180, using compare circuits 192 and 194 respectively. The compare circuits provide output signals which are applied to an AND circuit 196. The output of the AND circuit goes true when both the division counter and group counter correspond to the division and group data of the note identified by the word in the buffer register 180. The output of the AND circuit 196 is applied to an AND circuit 198 together with the output from the latch 190. Thus, when the Time On data corresponds to the counter 186, and the group and division counters point to the corresponding division of group data of the stored word, the output of the AND circuit 198 goes true, opening a gate 200, which gate signals on twelve output lines from a decode circuit 202 which decodes the note identifying bits in the buffer register 180. The twelve lines from the gate 200 are applied to the OR circuit 28, thus providing note information to the control logic 100 in the same manner as if the corresponding keys were operated in any of the three keyboards. This results in the key information being stored in the assign memory 82 in the manner described above, thereby activating a tone generator to sound the corresponding note. The note is sounded continuously just as though the corresponding key were depressed on the keyboard until the latch 190 is reset. The latch 190 is reset by the output signal from a compare circuit 204 which compares the Time Off bits in the buffer register 180 with the timing counter 186. When the counter is advanced to the time indicated by the Time Off bits, the latch 190 is reset, closing the gate 200 and thereby terminating the note just as though the corresponding key on the keyboard had been released. The output of the compare circuit 204 is also applied through the OR gate 184 to signal a demand for a new note to the priority select circuit 154.

It should be noted that although the counter 186 is shown in FIG. 2 as part of the keyer, the same counter is common to all four keyer circuits. When the last note in the stored sequence is terminated, the counter 186 must be reset to 0 to repeat the sequence of notes played in response to information stored in the sequencer shift register 118. This is desirable to permit the sequencer to repeat over and over the same pattern of notes. This is accomplished by a compare circuit 206 which compares the count condition of the counter 186 with the count condition of the sequence counter 126. It should be noted that during the CODE mode, the sequence counter 126 is advanced with each note interval for the particular resolution of the sequencer, e.g., for each eighth note interval. The sequence counter 126 provides the Time On and Time Off information stored for each note word in the assigned note word in the sequence shift register 118. At the end of the CODE mode, the sequence counter 126 corresponds to the Time Off of the last note in the sequence. The sequence counter is only reset at the start of the CODE mode but is not reset at the start of the PLAY mode. Thus, when the counter 186 matches the sequence counter 126, it corresponds to the time off of the last note or notes in the sequence to be turned off. When the output of the compare circuit 206 goes true, it resets the counter 186 back to zero, permitting the keyers to repeat the operation and automatically sequence through the notes stored in the shift register 118.

From the above description, it will be seen that a sequencer is provided which can be used to generate polyphonic tones. The tones are not limited to those of a single keyboard. There is no restriction on the time resolution, since the operator controls timing information. Only the notes played need be stored. Rests between notes are automatically controlled by the timing data.

What is claimed is:

1. An automatic sequencer for a keyboard instrument on which each key operates a switch for generating an on-off signal which indicates when the associated key is depressed and released for initiating and terminating a musical note generated by a tone generator when the key is respectively depressed and released, the sequencer comprising: a sequencer memory for storing data identifying the notes to be played by the sequencer, means responsive to the key-operated switches when one or more keys are depressed during a coding mode of operation for loading the sequencer memory with a data word for each depressed key, each data word identifying one of the depressed keys, time generating means for counting the musical beats of the notes played by operation of the keys, said means responsive to the key-operated switches, including means for storing the count condition of the time generating means at the time the keys are depressed with each word loaded in the sequencer memory, the count condition indicating the relative beat time at which the associated key identified by the data word was depressed, and means responsive to the release of any of the depressed keys for storing the count condition of the time generating means with the word in the sequence memory associated with the released key, the count condition indicating the relative beat time at which the associated key identified by the data word was released.

2. Apparatus of claim 1 further including means responsive to the data words played back from the sequencer memory during a playing mode for generating an on-off signal in response to each data word, said means for generating an on-off signal including means responsive to the count condition stored as part of the data word for controlling the time the signal goes on and the time the signal goes off, and means connecting the on-off signals in parallel with the on-off signals generated by said key operated switches for initiating and terminating the tones associated with the respective keys.

3. Apparatus of claim 1 wherein the time generating means includes a counter and means advancing the counter a fixed number of counts for each beat interval of the musical sequence being coded.

4. Apparatus of claim 3 wherein said means advancing the count condition of the counter includes a manually operated switch for increasing the counter with each operation of the switch.

5. Apparatus of claim 3 wherein said means advancing the counter includes an oscillator generating output pulses for incrementing the counter continuously at a predetermined rate to indicate elapsed time.

6. Apparatus of claim 3 wherein the sequencer memory is a shift register.

7. Apparatus of claim 6 further including means for shifting the register once in response to each key that is depressed on the keyboard during the coding mode of operation.

8. Apparatus of claim 7 further including means for shifting the register and rerecording the words in the register a number of times corresponding to the maximum word capacity of the register each time a key is released on the keyboard during the coding mode of operation, and means inserting the count condition of said counter in the word in the register associated with the released key as the word is recirculated in the shift register.

9. An automatic sequencer for a keyboard operated polyphonic tone generator comprising a sequencer memory storing a plurality of data words, each word identifying a particular musical note associated with one of the keys on said keyboard, each word further identifying the relative time the particular musical note is to go on and each word further identifying the relative time the particular note is to go off, a plurality of keyer circuits corresponding to the maximum number of tones to be generated simultaneously by the polyphonic tone generator in response to the sequencer, means transferring data words from the sequencer memory to the respective keyer circuits during a playing mode, each keyer circuit including means responsive to the note identifying data and the relative time on data of the word received from the memory for initiating the corresponding note from the polyphonic tone generator at a time determined by the time on data, and means responsive to the relative time off data of the word received from the memory for terminating the corresponding note from the polyphonic tone generator at a time determined by the time off data.

10. Apparatus of claim 9 wherein each keyer circuit includes means for storing one word from the sequencer memory, means in each keyer generating a demand signal when the time on data of the word stored in the keyer is zero, and means responsive to the demand signal for transferring a new word from the sequencer memory to the keyer circuit.

11. Apparatus of claim 9 further including a counter, means advancing the counter at a rate determined by the musical tempo, means in each keyer for comparing the time on and time off data with the counter, means responsive to the comparing means for indicating the relative time at which the corresponding tone generator is activated to a note and means responsive to the comparing means for indicating the relative time at which the corresponding tone generator is released to release a note.

12. An automatic sequencer for generating musical notes comprising: data storage means, means storing data in said storage means identifying the individual musical notes to be played, means storing data in said storing means identifying the relative time each of said individual notes is to be turned on and turned off, a clock source indicating elapsed time, means starting the clock source and reading out said note and relative time data in predetermined sequence from the storage means, means comparing the relative time data with the elapsed time indicated by the clock source for indicating when a particular note is to be turned on, means comparing the relative time data with the elapsed time indicated by the clock source for indicating when a particular note is to be turned off, means responsive to the note data and the comparing means for generating the particular note at the relative starting and ending times identified by said stored data.

13. Apparatus of claim 12 further including means resetting the clock source when all of the notes stored in the memory have been generated, and means repeating the readout of said note data from the storage means.

14. In a polyphonic keyboard instrument having a plurality of tone generators wherein depression of one or more keys causes a signal to be initiated for each key indicating that the particular key has been depressed, the signal when initiated activating a tone generator, and wherein release of the key causes a signal to be terminated and the tone generator to be released, apparatus for generating said signals automatically for activating and releasing the tone generators, said apparatus comprising:

a sequencer memory for storing a plurality of data words, a counter, means advancing the counter continuously during a loading mode of operation, means responsive to the depression of one or more keys during each counting state of the counter for storing a data word in the sequencer memory for each of the depressed keys including means coding each of the stored data words to identify one of the depressed keys and the counting state of the counter at the time the keys were depressed, means responsive to the release of one or more of the depressed keys during subsequent counting states of the counter for coding said stored data words associated with the released keys to further identify the counting state of the counter at the time the respective keys were released, means reading out the stored data words from the sequencer memory during a playing mode, and means responsive to the data words read out of the sequencer for generating signals corresponding to the respective keys, the signals being initiated and terminated at the relative times corresponding to the counting states stored with each word.

* * * * *

UNITED STATES PATENT AND TRADEMARK OFFICE

CERTIFICATE OF CORRECTION

PATENT NO. : 4,160,399

DATED : July 10, 1979

INVENTOR(S) : RALPH DEUTSCH

It is certified that error appears in the above-identified patent and that said Letters Patent are hereby corrected as shown below:

Column 8, line 54, after "division" delete "of" and substitute therefor -- and --.

Column 10, line 24, delete "count condition of the"; Claim 4

Column 10, line 25, after "the" insert -- count condition of the --. Claim 4

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*